US009109361B2

(12) United States Patent
Daudet et al.

(10) Patent No.: US 9,109,361 B2
(45) Date of Patent: Aug. 18, 2015

(54) BRACING BRIDGING MEMBER

(71) Applicant: Simpson Strong-Tie Company, Inc., Pleasanton, CA (US)

(72) Inventors: Larry Randall Daudet, Brentwood, CA (US); Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 14/468,269

(22) Filed: Aug. 25, 2014

(65) Prior Publication Data

US 2015/0033662 A1 Feb. 5, 2015

Related U.S. Application Data

(63) Continuation-in-part of application No. 14/062,712, filed on Oct. 24, 2013, now Pat. No. 8,813,456, which is a continuation of application No. 13/281,429, filed on Oct. 26, 2011, now Pat. No. 8,590,255.

(51) Int. Cl.

| | |
|---|---|
| ***E04C 3/02*** | (2006.01) |
| ***E04C 3/07*** | (2006.01) |
| ***E04C 3/04*** | (2006.01) |
| ***E04B 2/76*** | (2006.01) |

(52) U.S. Cl.

CPC . *E04C 3/07* (2013.01); *E04B 2/763* (2013.01); *E04C 3/02* (2013.01); *E04C 3/04* (2013.01); *E04C 2003/026* (2013.01); *E04C 2003/0473* (2013.01)

(58) Field of Classification Search

CPC ..... E04C 3/07; E04C 2003/0473; E04C 2003/026; E04C 3/02; E04B 2/763

USPC ..... 52/243, 317, 349, 481.1, 655.1, 696, 52/702, 712, 741.14, 745.12

See application file for complete search history.

(56) References Cited

U.S. PATENT DOCUMENTS

| | | | |
|---|---|---|---|
| 529,154 | A | 11/1894 | Banks |
| 719,191 | A | 1/1903 | Collins |
| 992,941 | A | 5/1911 | Danielson |
| 1,101,745 | A | 6/1914 | Jones |
| 1,346,426 | A | 7/1920 | Sherbner |
| 1,791,197 | A | 2/1931 | Dickson |
| 2,365,501 | A | 12/1944 | Walstrom |
| 2,873,828 | A | 2/1959 | Zitomer |
| 2,900,677 | A | 8/1959 | Yetter |
| 2,905,426 | A | 9/1959 | Ross |
| 2,918,995 | A | 12/1959 | Kruger |

(Continued)

OTHER PUBLICATIONS

"Construction Dimensions", Apr. 2012, cover page and Simpson Strong-Tie/SUBH advertisement page, SFCFS12-E, Association of the Wall and Ceiling Industry (AWCI), USA.

(Continued)

*Primary Examiner* — Adriana Figueroa

(74) *Attorney, Agent, or Firm* — James R. Cypher; Charles R. Cypher

(57) ABSTRACT

A building connection between a plurality of vertical wall studs made with a plurality of bridging members to brace the wall studs. The bridging members are formed with mounting sections that are received in openings of the wall studs and the mounting sections are bracketed by connecting sections that are used to join the bridging members to each other. The bridging members interface with the web of the wall studs to brace them.

32 Claims, 12 Drawing Sheets

(56) References Cited

U.S. PATENT DOCUMENTS

| | | | | |
|---|---|---|---|---|
| 3,083,794 | A | 4/1963 | Stovail | |
| 3,102,306 | A | 9/1963 | Hutchinson | |
| 3,126,928 | A | 3/1964 | McMillan | |
| 3,299,839 | A | 1/1967 | Nordbak | |
| 3,322,447 | A * | 5/1967 | Biggs | 403/252 |
| 3,482,369 | A | 12/1969 | Burke | |
| 3,490,604 | A | 1/1970 | Klein | |
| 3,606,227 | A | 9/1971 | Klein | |
| 3,653,172 | A | 4/1972 | Schwartz | |
| 3,778,952 | A * | 12/1973 | Soucy | 52/667 |
| 3,858,988 | A | 1/1975 | Cohen | |
| 3,897,163 | A | 7/1975 | Holmes | |
| 4,018,020 | A | 4/1977 | Sauer et al. | |
| 4,027,453 | A | 6/1977 | Bridge | |
| 4,043,689 | A | 8/1977 | Spencer | |
| 4,075,810 | A | 2/1978 | Zakrzewski et al. | |
| 4,128,979 | A | 12/1978 | Price | |
| 4,140,417 | A | 2/1979 | Danielsen et al. | |
| 4,174,911 | A | 11/1979 | Maccario et al. | |
| 4,208,851 | A | 6/1980 | Sauer | |
| 4,235,054 | A | 11/1980 | Cable et al. | |
| 4,246,736 | A | 1/1981 | Kovar et al. | |
| 4,406,374 | A | 9/1983 | Yedor | |
| 4,426,822 | A | 1/1984 | Gailey | |
| 4,428,172 | A | 1/1984 | Larsson | |
| 4,448,004 | A | 5/1984 | Thorsell | |
| 4,464,074 | A | 8/1984 | Green | |
| 4,516,874 | A | 5/1985 | Yang et al. | |
| 4,522,009 | A | 6/1985 | Fingerson | |
| 4,586,841 | A | 5/1986 | Hunter | |
| 4,625,415 | A | 12/1986 | Diamontis | |
| 4,693,047 | A | 9/1987 | Menchetti | |
| 4,791,766 | A | 12/1988 | Egri | |
| 4,809,476 | A | 3/1989 | Satchell | |
| 4,840,005 | A | 6/1989 | Cochrane | |
| 4,850,169 | A | 7/1989 | Burkstrand et al. | |
| 4,858,407 | A | 8/1989 | Smolik | |
| 4,864,791 | A | 9/1989 | Platt | |
| 4,912,894 | A | 4/1990 | Platt | |
| 4,914,878 | A | 4/1990 | Tamaki et al. | |
| 4,916,877 | A | 4/1990 | Platt | |
| 4,951,436 | A | 8/1990 | Burkstrand et al. | |
| 5,092,100 | A | 3/1992 | Lambert et al. | |
| 5,127,760 | A | 7/1992 | Brady | |
| 5,155,962 | A | 10/1992 | Burkstrand et al. | |
| 5,189,857 | A | 3/1993 | Herren | |
| 5,274,973 | A | 1/1994 | Liang | |
| 5,287,664 | A | 2/1994 | Schiller | |
| 5,325,651 | A | 7/1994 | Meyer et al. | |
| 5,363,622 | A | 11/1994 | Sauer | |
| 5,403,110 | A | 4/1995 | Sammann | |
| 5,446,969 | A | 9/1995 | Terenzoni | |
| 5,600,926 | A | 2/1997 | Ehrlich | |
| 5,605,024 | A | 2/1997 | Sucato et al. | |
| 5,632,128 | A | 5/1997 | Agar | |
| 5,664,392 | A | 9/1997 | Mucha | |
| 5,669,198 | A | 9/1997 | Ruff | |
| 5,671,580 | A | 9/1997 | Chou | |
| 5,682,935 | A | 11/1997 | Bustamante | |
| 5,697,725 | A | 12/1997 | Ballash et al. | |
| 5,720,138 | A | 2/1998 | Johnson | |
| 5,784,850 | A | 7/1998 | Elderson | |
| 5,876,006 | A | 3/1999 | Sharp | |
| 5,899,041 | A | 5/1999 | Durin | |
| 5,904,023 | A * | 5/1999 | diGirolamo et al. | 52/712 |
| 5,921,411 | A | 7/1999 | Merl | |
| 5,943,838 | A | 8/1999 | Madsen | |
| 5,964,071 | A | 10/1999 | Sato | |
| 6,021,618 | A | 2/2000 | Elderson | |
| 6,164,028 | A * | 12/2000 | Hughes | 52/317 |
| 6,199,336 | B1 | 3/2001 | Poliquin | |
| 6,242,698 | B1 | 6/2001 | Baker, III et al. | |
| 6,260,318 | B1 | 7/2001 | Herren | |
| 6,290,214 | B1 | 9/2001 | DeSouza | |
| 6,301,854 | B1 | 10/2001 | Daudet et al. | |
| 6,315,137 | B1 | 11/2001 | Mulford | |
| 6,418,695 | B1 | 7/2002 | Daudet | |
| D463,575 | S | 9/2002 | Daudet | |
| 6,578,335 | B2 | 6/2003 | Poliquin | |
| 6,644,603 | B2 | 11/2003 | Bailleux | |
| 6,662,520 | B1 | 12/2003 | Nelson | |
| 6,688,069 | B2 | 2/2004 | Zadeh | |
| 6,694,695 | B2 | 2/2004 | Collins | |
| 6,701,689 | B2 | 3/2004 | diGirolamo | |
| 6,702,270 | B1 | 3/2004 | Reschke | |
| 6,708,460 | B1 | 3/2004 | Elderson | |
| 6,739,562 | B2 * | 5/2004 | Rice | 248/247 |
| 6,792,733 | B2 | 9/2004 | Wheeler | |
| 6,920,734 | B2 | 7/2005 | Elderson | |
| 7,017,310 | B2 | 3/2006 | Brunt | |
| 7,021,021 | B2 | 4/2006 | Saldana | |
| 7,104,024 | B1 | 9/2006 | diGirolamo et al. | |
| 7,159,369 | B2 | 1/2007 | Elderson | |
| 7,168,219 | B2 | 1/2007 | Elderson | |
| 7,174,690 | B2 | 2/2007 | Zadeh | |
| D558,039 | S | 12/2007 | Skinner | |
| D573,873 | S | 7/2008 | Wall | |
| 7,398,621 | B2 | 7/2008 | Banta | |
| 7,503,150 | B1 | 3/2009 | diGirolamo | |
| 7,520,100 | B1 | 4/2009 | Herrman | |
| 7,559,519 | B1 | 7/2009 | Dragic | |
| 7,596,921 | B1 * | 10/2009 | diGirolamo et al. | 52/696 |
| 7,634,889 | B1 | 12/2009 | diGirolamo et al. | |
| 7,739,850 | B2 | 6/2010 | Daudet | |
| 7,836,657 | B1 | 11/2010 | diGirolamo | |
| 7,955,027 | B2 | 6/2011 | Nourian et al. | |
| 8,011,160 | B2 | 9/2011 | Rice | |
| D648,249 | S | 11/2011 | Noble et al. | |
| 8,083,187 | B2 | 12/2011 | Bernard et al. | |
| D657,891 | S | 4/2012 | Jones | |
| 8,167,250 | B2 | 5/2012 | White | |
| 8,205,402 | B1 | 6/2012 | diGirolamo | |
| 8,225,581 | B2 | 7/2012 | Strickland et al. | |
| D667,249 | S | 9/2012 | London | |
| D667,718 | S | 9/2012 | Preda | |
| 8,387,321 | B2 | 3/2013 | diGirolamo et al. | |
| D692,746 | S * | 11/2013 | Lawson et al. | D8/394 |
| 2002/0059773 | A1 | 5/2002 | Elderson | |
| 2003/0037494 | A1 | 2/2003 | Collins | |
| 2003/0089053 | A1 | 5/2003 | Elderson | |
| 2003/0145537 | A1 | 8/2003 | Bailey | |
| 2003/0167722 | A1 | 9/2003 | Klein et al. | |
| 2007/0251186 | A1 | 11/2007 | Rice | |
| 2010/0126103 | A1 | 5/2010 | diGirolamo et al. | |
| 2011/0154770 | A1 | 6/2011 | Friis | |
| 2013/0104490 | A1 | 5/2013 | Daudet et al. | |

OTHER PUBLICATIONS

"SUBH/MSUBH: Bridging Connectors for Cold-Formed Steel Stud Construction", Simpson Strong-Tie Company flier, Apr. 1, 2012, 2 pages, S-SUBHMSUBH12, Simpson Strong-Tie Company, Inc., Pleasanton, CA, USA.

"Bridging, Bracing & Backing: Spazzer 5400 Spacer Bar (SPZS), Bar Guard (SPBG) & Grommet (SPGR)". Clip Express Product Catalog: Clips, Connectors, Framing Hardware, Apr. 2012, p. 77. Clark Dietrich Building Systems, USA.

"Metal-Lite Products". Metal Lite website, metal-lite.net. Accessed Sep. 20, 2013, one page. Metal Lite 2012, USA.

"Mantisgrip Product Catalog 2012". Catalog, 2012, 10 pages and cover. Mantisgrip 2012, USA.

"Wall Bridging Detail". NuconSteel Product Catalog, 2003, front cover, table of contents, p. 34. NuconSteel., USA.

"Double Deep-Leg Track", "Bridge Clip Installation", "BC600 & BC800 Installation", "BridgeBar", "BridgeClip", "BC600 or BC800". The Steel Network, Inc. Product Catalog, Jan. 2004, front cover, p. 11,27,49. Steel Network, Inc., USA.

"U-Channel Bridging Connectors for Cold-Formed Steel Construction", Simpson Strong-Tie Product Flyer, Sep. 1, 2012, front and back cover pages and pp. 1-11, vol. F-SUBHMSUBH12, Simpson Strong-Tie Company, Inc., Pleasanton, CA.

* cited by examiner

BRACING BRIDGING MEMBER

BACKGROUND OF THE INVENTION

The present invention relates to steel stud building wall systems and especially to apparatuses for stabilizing steel studs to prevent lateral movement and torsion in such systems.

Many buildings are constructed with steel stud wall framing. When a wall is built with any kind of stud, wood or steel, it is generally desirable to fix sequential studs relative to each other against lateral movement and torsion. In steel-stud walls, an elongated steel bridging member is typically inserted horizontally through pre-punched openings in a series of vertical studs to keep them aligned. Steel studs have excellent columnar strength when they are straight, but a significant portion of that strength is lost if the studs are twisted. Because steel studs are particularly vulnerable to torsion, the bridging members, which are typically channel-shaped, having a horizontal web and two vertical side flanges, are made to closely fit the openings in the vertical studs in order to maximize torque resistance. In additional to mechanical torque, metal studs can twist or bend in response to the heat of a fire when the drywall sheathing, which acts as a firebreak, is destroyed. When metal studs twist or bend, they lose their weight-bearing capacity, multiplying the damage caused directly by fire.

While channel-shaped bridging members closely received in the openings can help restrain the studs from twisting, some twisting can still occur and the studs can still shift or bend parallel to the wall. A variety of sheet metal brackets, beginning with a simple right angle, are used with channel-shaped bridging members to prevent this shifting or bending. These brackets can be connected to the studs and the bridging member by means of separate fasteners, interlocking sections on the bracket that engage one of the studs and the bridging member or a combination of fasteners and interlocking forms.

The prior art also includes short bridging members that span only adjacent studs and have ends tailored for fastening to the wall studs and/or to each other through extensions that are inserted through the openings in the wall studs. These bridging members are typically a fixed length. U.S. Pat. No. 6,164,028, granted to John P. Hughes teaches a system of connecting such short bridging members by forming one end of the web of each bridging member to extend through the opening in the stud and to closely receive the web of the stud on both sides, and then to attach the end of another bridging member to that extension.

The prior art also includes elongated bridging members with a series of slots that allow the bridging member to not only be inserted through the openings in the wall studs but also mate with the web of the wall studs on either side of the openings. U.S. Pat. No. 7,168,219, granted to William L. Elderson, teaches such bridging members. U.S. Pat. No. 7,168,219 also teaches a special bridging member that is designed to connect in this manner to just two side-by-side studs.

It is an object of the present invention to provide bridging members that can be installed quickly in a variety of wall environments and that can form a strong connection that resists both lateral and torsional loads.

SUMMARY OF THE INVENTION

The present invention provides a bridging member that when used in series with other bridging members firmly connects and stabilizes a building wall made up of steel studs.

The bridging members pass through openings in each of the studs in the section of the wall. The bridging members are designed to keep the studs in alignment along the length of the wall when they are installed through the studs.

The present invention provides a bridging member with edges that interlock with the web of a wall stud to provide exceptional torsional rigidity. The edges are braced by the body plates of the bridging member and diagonally disposed flanges of the bridging member, allowing them to resist substantially high loads.

In the present invention, first and second laterally spaced studs are connected and braced by first and second bridging members. The studs are provided with a front face and an opposite face disposed laterally therefrom on the opposed face with an opening there through that communicates between the front face and the opposite face. The second stud is disposed substantially parallel to and spaced a selected distance away from the first stud with the opposite face of the second stud facing and being disposed parallel to the front face of the first stud.

In the present invention, first and second bridging members are provided to engage and be received through the openings in the first and second studs respectively. The first and second bridging members each have a longitudinal, central axis with a mounting section and opposed first and second connecting sections on either side of the mounting section along the longitudinal, central axis. The mounting section of the first bridging member is received in the opening of the first stud and the mounting section of the second bridging member is received in the opening of the second stud. The second connecting section of the first bridging member projects substantially away from the opposite face of the first stud and also from the opposite face of the second stud, and the first connecting section of the first bridging member projects away from the front face of the first stud and extends towards the opposite face of the second stud. The second connecting section of the second bridging member projects substantially away from the opposite face of the second stud and extends toward the front face of the first stud with the second connecting section of the second bridging member engaging the first connecting section of the first bridging member such that the second stud is braced by the first stud. The first connecting section of the second bridging member projects away from the front face of the second stud and projects away from the front face of the first stud.

The first connecting section of the second bridging member is available to be connected to the second connecting section of another bridging member made according to the present invention, as is the second connecting section of the first bridging member.

According to the present invention, one or more of the bridging members making the connections between the plurality of studs are provided with the mounting section having a first body part and a second body part connected thereto by means of a neck which can fit through the opening in a stud. The first and second body parts each have one or more side flanges attached thereto at an angle, and each body part also has a first inner edge with a first web interface portion and a second web interface portion, and when the bridging member engages a wall stud the first inner edges of the first and second body parts contact or are disposed closely adjacent to the web of a stud on the opposed faces of the stud.

According to the present invention, one or more of the bridging members making the connections between the plurality of studs are provided with the mounting section having a first body part and a second body part connected thereto by means of a neck which can fit through the opening in the stud.

The first and second body parts each have one or more side flanges attached thereto at an angle, and the side flanges have inner edges that contact or lie closely adjacent to the central web of the wall stud when the bridging member engages the wall stud. The one or more side flanges are set at an acute angle with respect to the longitudinal, central axis of the bridging member such that the one or more side flange flares outwardly from the longitudinal, central axis as they approach the central web of the stud.

According to the present invention, the first body part and the second body part are substantially planar and lie in substantially the same plane.

According to the present invention, the first and second connecting sections of the first and second bridging members are channel shaped, and the first connecting section of each of the first and second bridging members has a first width, and the second connecting section of each of the first and second bridging members has a different second width, and one of the widths is slightly larger than the other such that connecting sections nestingly engage.

The present invention also encompasses making the connection between a plurality of studs with one or more of the bridging members of the present invention, wherein the first body parts of one or more bridging members are placed adjacent the central web of a plurality of wall studs so that the first inner edges of the first side flanges of the first body parts are adjacent the central web of the studs and fastening the second connecting sections of the bridging members to the first connecting section of the bridging members.

In the preferred embodiment, the diagonally disposed flanges of the mounting section of the bridging member meet with parallel elongated flanges of the first and second connecting sections of the bridging member that run parallel to the elongated, longitudinal axis of the bridging member.

According to the present invention, the first and second connecting sections of the bridging member can be a variety of lengths and notches can be provided in the elongated flanges of the connecting sections to allow for the trimming of the connecting sections. Preferably, the connecting sections are notched at selected locations that correspond to using a plurality of the bridging members together to span standard spacings between adjacent studs.

The exceptional strength of the interlocking connection between the bridging members and the wall studs allow the bridging members to be firmly connected to the wall studs without the use of fasteners.

DETAILED DESCRIPTION OF THE INVENTION

Figure 1:
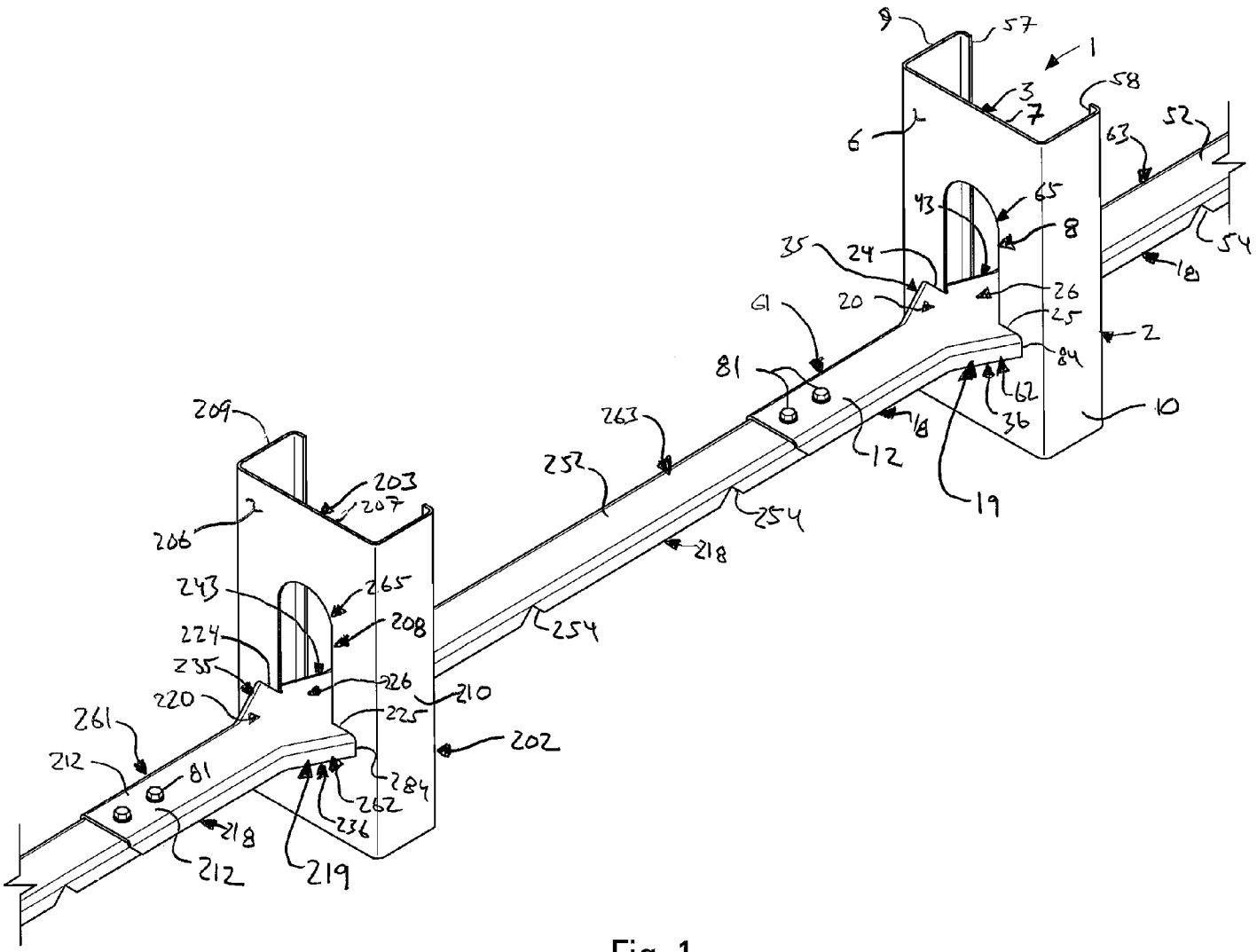
FIG. 1 is an upper front right perspective view of the present invention, showing a wall section with two typical cold-formed steel wall studs joined by the bridging members of the present invention.
Figure 2:
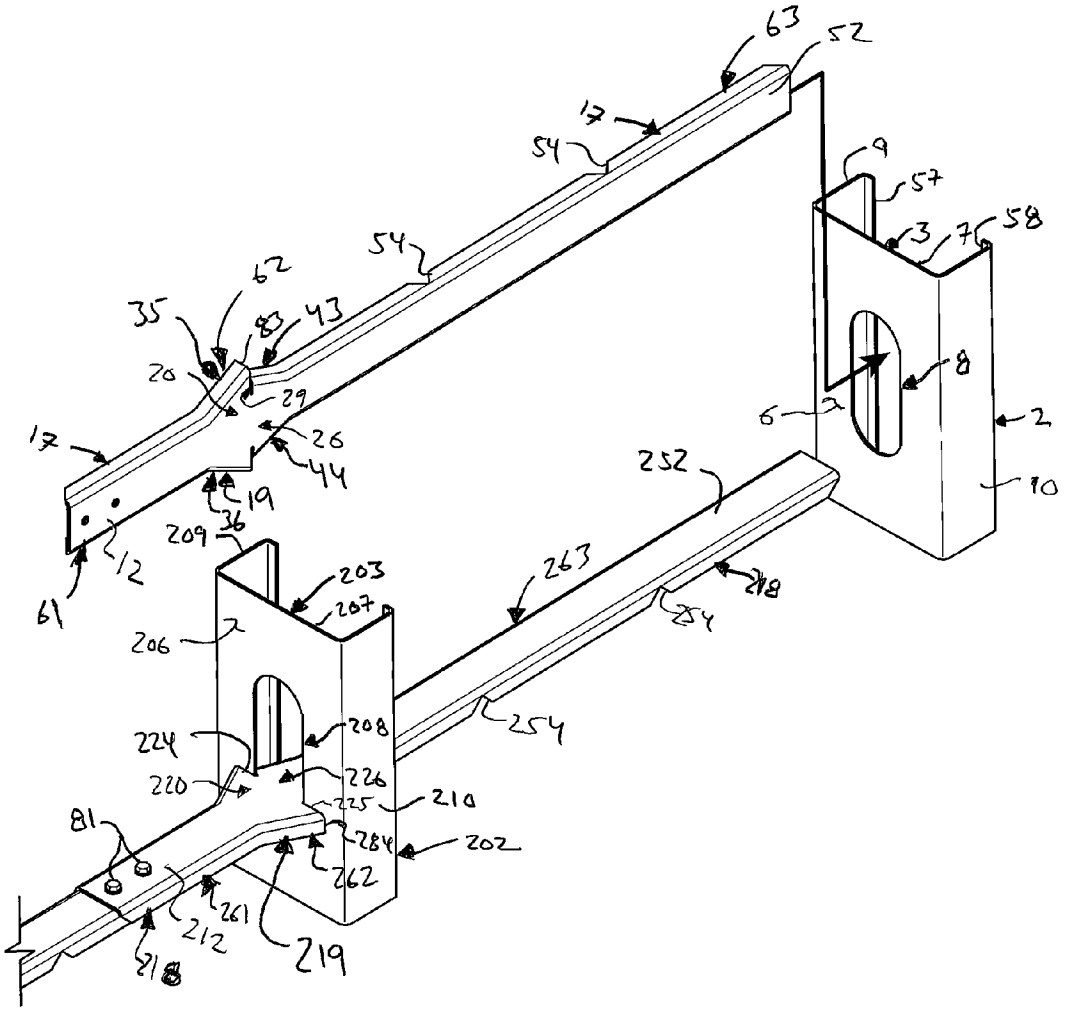
FIG. 2 is an upper front right perspective view of the present invention, showing a first bridging member inserted through a wall stud and connected to another bridging member at its first end and a second bridging member ready to be inserted through a second wall stud. The arrow in the drawing shows a possible path for inserting the second bridging member into the opening.
Figure 3:
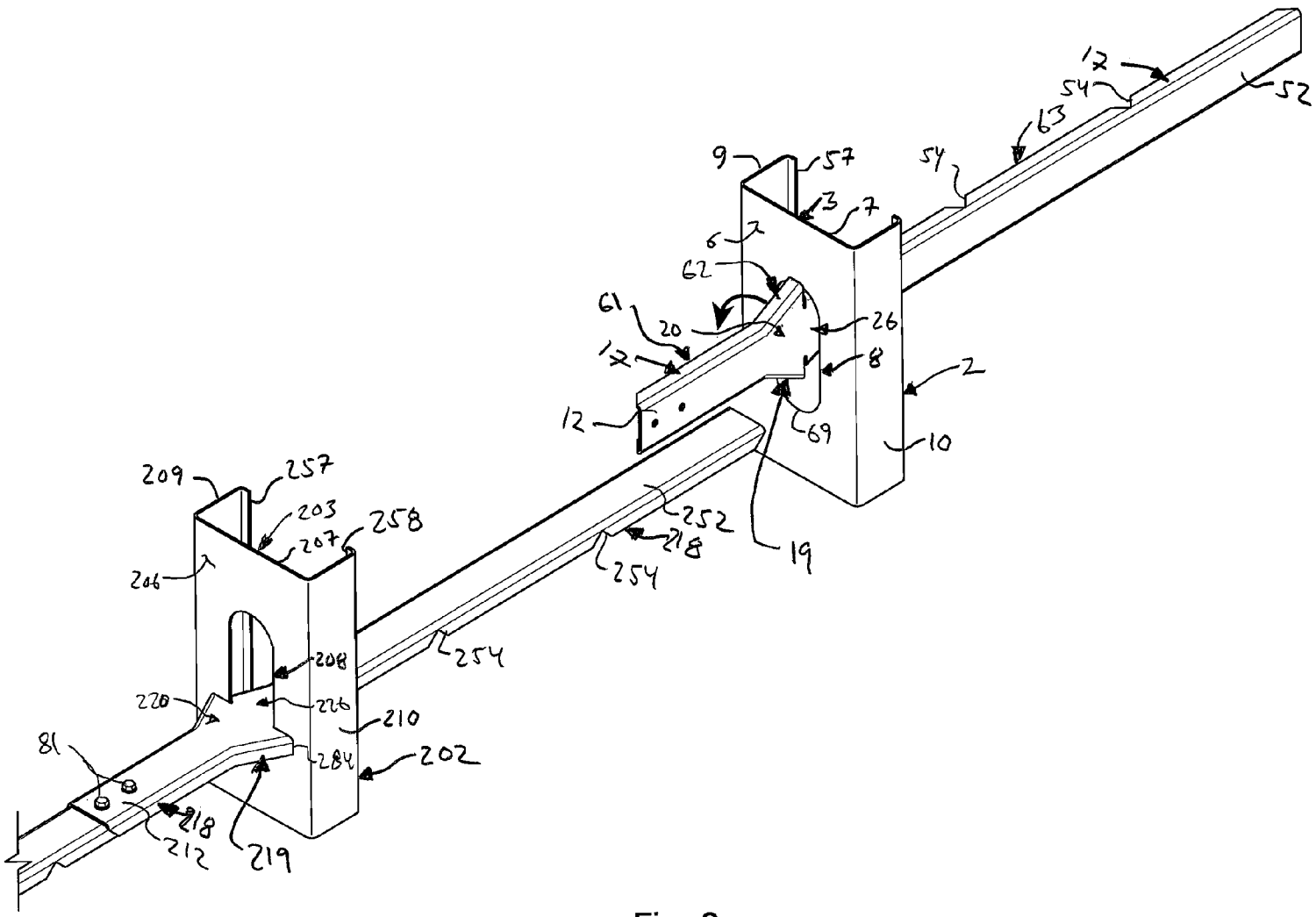
FIG. 3 is an upper front right perspective view of the present invention similar to FIG. 2, showing the second bridging member inserted through the second wall stud but not yet engaging the web of the second wall stud. The arrow shows a possible direction for rotating the second bridging member to engage the web of the second wall stud.

As shown in FIG. 1, the present invention is a building connection 1 that comprises a plurality of substantially vertical wall studs 2 and 202 and a plurality of substantially horizontal, interconnected bridging members 19 and 219. The wall studs 2 and 202 are typically one of several sequentially-arranged, cold-formed steel studs 2 and 202 in the frame of a building wall. The bridging members 19 and 219 are separate, preferably cold-formed steel members that interface with the plurality of wall studs 2 and 202. The first and second bridging members 19 and 219 each have a longitudinal, central axis 60 and 260 that are preferably in alignment. Each bridging member 19 and 219 has a mounting section 62 and 262 and opposed first and second connecting sections 61 and 261, and 63 and 263 on either side of the mounting section 62 and 262 along the longitudinal, central axis 60 and 260. The mounting section 62 of the first bridging member 19 is received in the opening 8 of the first stud 2 and the mounting section 262 of the second bridging member 219 is received in the opening 8 of the second stud 202. The second connecting section 63 of the first bridging member 19 projects substantially away from the opposite face 7 of the first stud 2 and also from the opposite face 207 of the second stud 202, and the first connecting section 61 of the first bridging member 19 projects away from the front face 6 of the first stud 2 and extends towards the opposite face 207 of the second stud 202. The second connecting section 263 of the second bridging member 219 projects substantially away from the opposite face 207 of the second stud 202 and extends toward the front face 6 of the first stud 2 with the second connecting section 263 of the second bridging member 219 engaging the first connecting section 61 of the first bridging member 19 such that the second stud 202 is braced by the first stud 2. The first connecting section 261 of the second bridging member 219 projects away from the front face 206 of the second stud 202 and projects away from the front face 6 of the first stud 2. The first connecting section 261 of the second bridging member 219 is available to be connected to the second connecting section 263 of another bridging member 219 made according to the present invention, as is the second connecting section 63 of the first bridging member 19.

In the preferred embodiment, the bridging members 19 and 219 are identical except for their lengths. Preferably, the first and second connecting sections 61 and 261, 63 and 263 of the first and second bridging members 19 and 219 are channel shaped, and the first connecting section 61 and 261 of each of the first and second bridging members 19 and 219 has a first width, and the second connecting section 63 and 263 of each of the first and second bridging members 19 and 219 has a different second width, and one of the widths is slightly larger than the other such that connecting sections nestingly engage. As shown in the drawings the second connecting sections 63 and 263 are dimensioned to be received within the first connecting sections 61 and 261.

Figure 5:
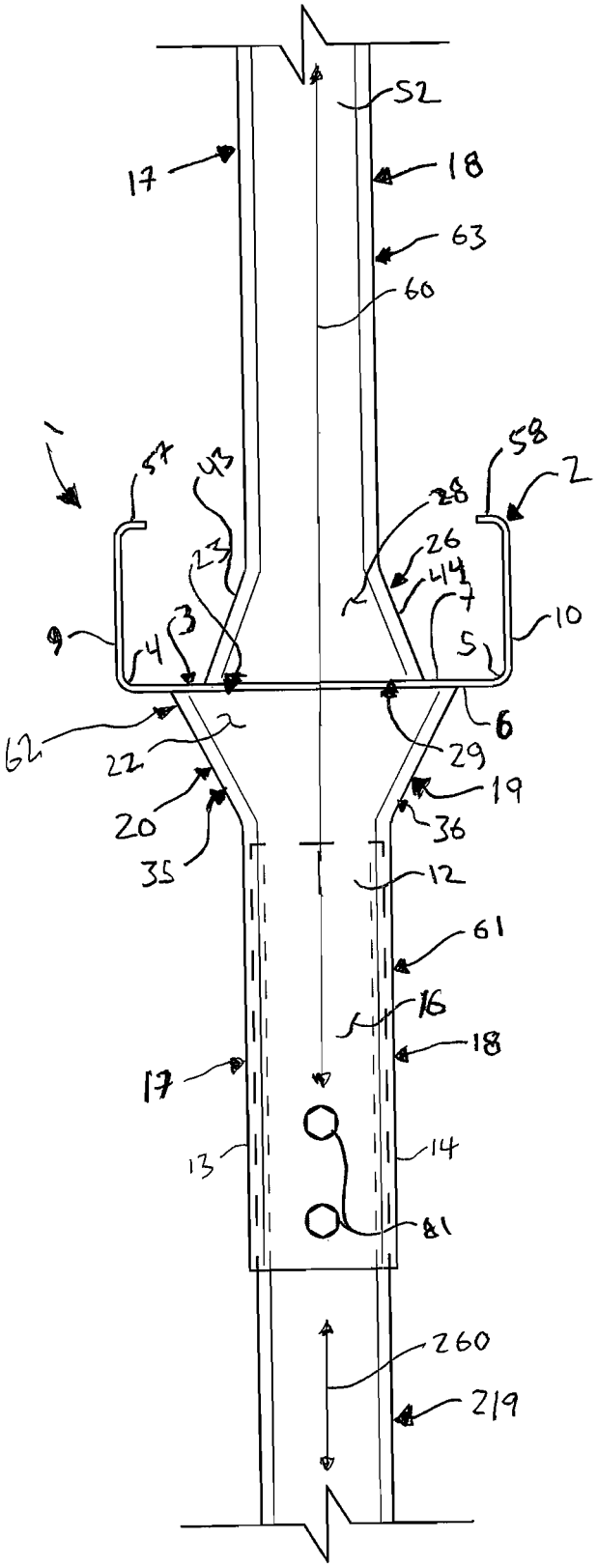
FIG. 5 is a top plan view of a connection made between a typical cold-formed steel wall stud and the preferred form of the bridging members of the present invention.

FIG. 1 shows a first wall stud 2 and second wall stud 202. First and second wall studs 2 and 202 are identical. The first wall stud 2 will be described in detail with numbering for the second wall stud being similar, except the number identifiers for the second wall stud are 200 units higher, for example the central web 3 of first stud 2 is identified by the numeral 3, and the central web of second wall stud 200 is 203. As shown in FIG. 5, the first stud 2 includes a central web 3 having a first side 4 and a second side 5, a front face 6 and an opposite face 7, and an opening 8 that communicates between the front face 6 and the opposite face 7. The central web 3 is typically rectangular and occupies a vertical plane. A first side flange 9 is integrally attached to the first side 4. A second side flange 10 is integrally attached to the second side 5. The first and second side flanges 9 and 10 are typically rectangular and occupy vertical planes that are mutually parallel and are both orthogonal to the central web 3. The central web 3 or 203 of a wall stud 2 or 202 is typically 3.635 (3⅝), 6 or 8 inches wide, although there are wall studs 2 or 202 as narrow as 2.5 inches and as wide as 12 inches. The elongated opening 8 is typically 1.5 inches wide and 3.25 inches tall. The first and second side flanges 9 and 10 are typically 1.62 (1⅝) inches wide, although there are wall studs 2 and 202 with first and second side flanges 9 and 10 or 209 and 210 that are 2 inches wide and 2.5 inches wide. The second stud 202 is disposed substantially parallel to and spaced a selected distance away from the first stud 2 with the opposite face 207 of the second stud 202 facing and being disposed parallel to the front face 6 of the first stud 2, and the front face 206 of the second stud 202 being disposed facing away from the front face 6 of the first stud 2.

As shown in FIG. 5, typically, a first stiffening flange 57 is attached to the first side flange 9, and a second stiffening flange 58 is attached to the second side flange 10. The wall studs 2 and 202 are generally channel-shaped.

FIG. 1 shows a first bridging member 19 and a second bridging member 219. As shown in FIG. 1, in the preferred embodiment first and second bridging members 19 and 219 are identical, although they need not be. FIGS. 14-17 show first and second bridging members 19 and 219 with differing lengths; however, other variations in the bridging members 19 and 219 are possible without departing from the scope of the claimed invention. The first bridging member 19 will be described in detail with numbering for the second bridging member being similar, except the number identifiers for the second bridging member are 200 units higher, for example the first end web 12 of first bridging member 19 is 12, and the first end web 212 of the second bridging member 219 is 212.

As shown in FIGS. 5-10, the first bridging member 19 has a first end web 12, having first and second boundaries 13 and 14, to which first and second boundary flanges 17 and 18 are connected. These members make up the first connecting section 61. The bridging member 19 also has web-like first and second bodies 20 and 26. First body 20 is preferably formed with first and second side flanges 35 and 36, and second body plate 26 is formed with first and second side flanges 43 and 44. These members make up the mounting section 62. The first bridging member 19 also has a second end web 52, having first and second boundaries 13 and 14, to which boundary flanges 17 and 18 are connected. These members make up the second connecting section 63.

Figure 11:
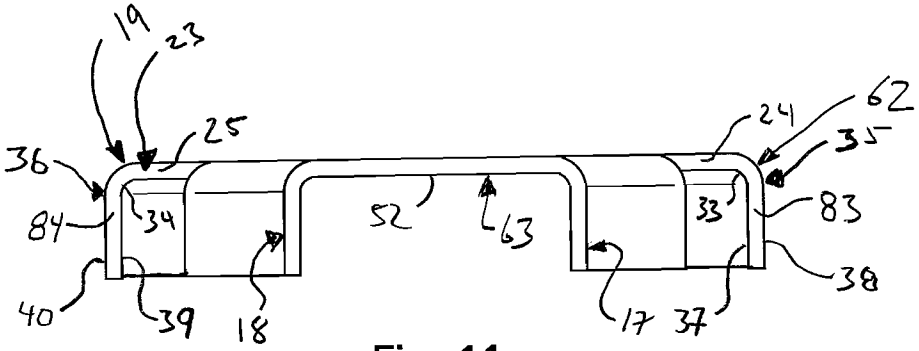
FIG. 11 is a front elevation view of the preferred form of the bridging member of the present invention.
Figure 12:
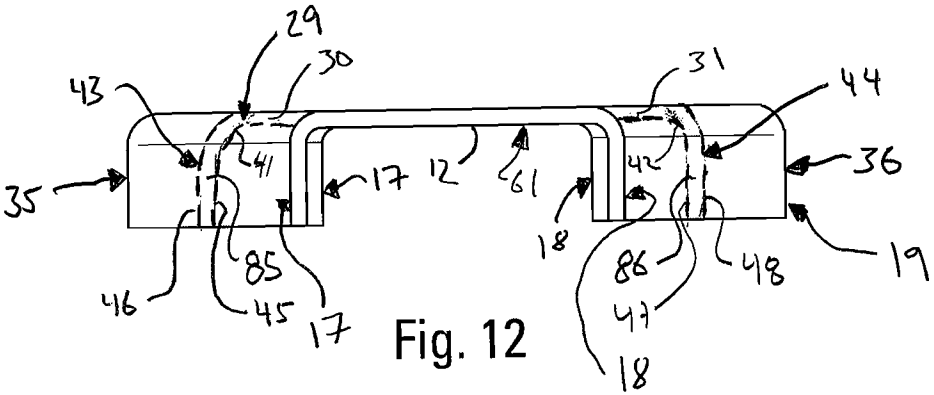
FIG. 12 is a rear elevation view of the preferred form of the bridging member of the present invention.
Figure 13:
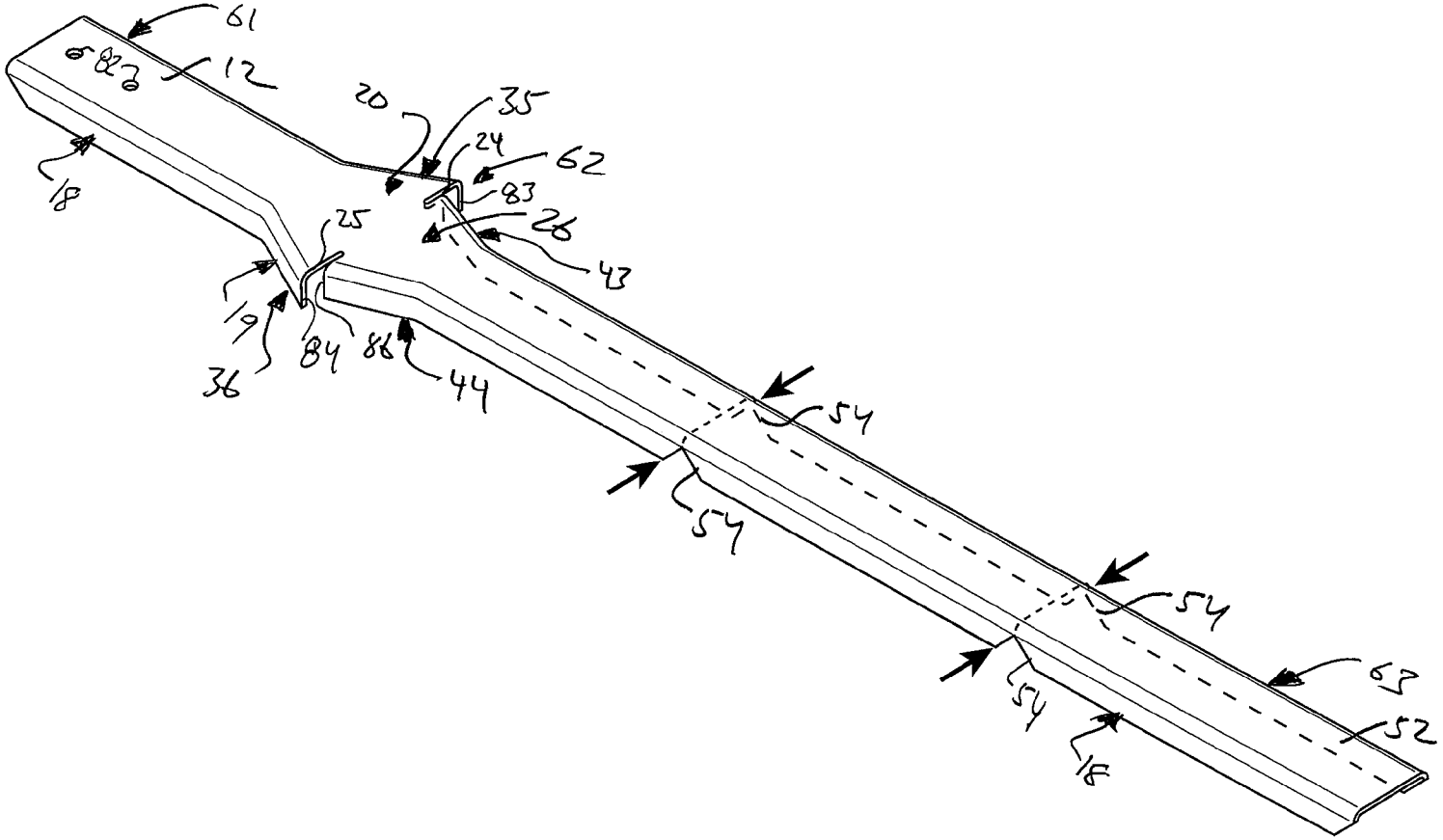
FIG. 13 is an upper rear left perspective view of the preferred form of the bridging member of the present invention. The arrows and dotted lines across the bridging member show where the bridging member can be broken to vary the length of the bridging member.
Figure 14:
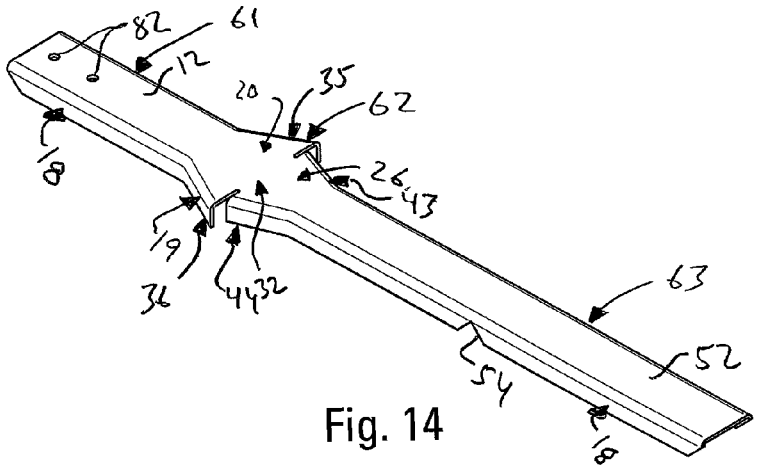
FIG. 14 is an upper rear left perspective view of the preferred form of a bridging member that has been shortened to accommodate more closely spaced studs.
Figure 15:
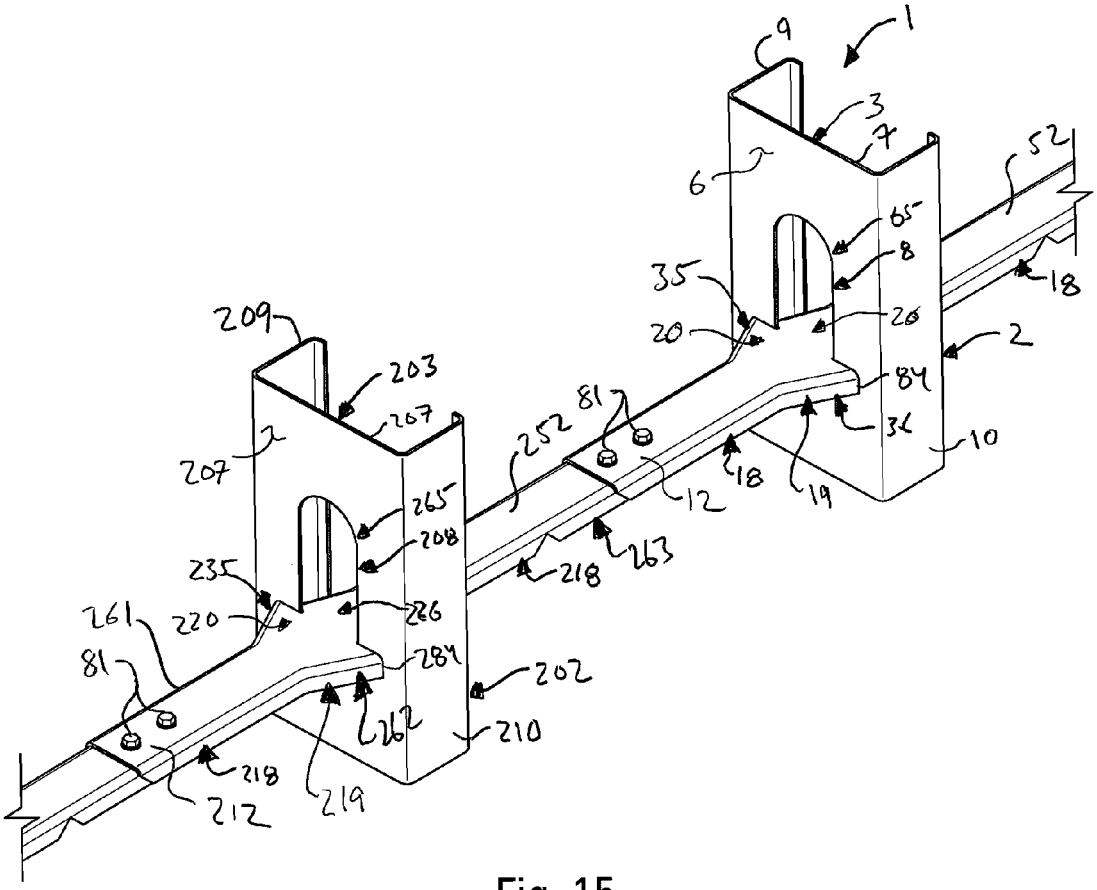
FIG. 15 is an upper front right perspective view of the present invention, showing a wall section with two typical cold-formed steel wall studs joined by the bridging members of the present invention where one of the first bridging member has been shortened.
Figure 16:
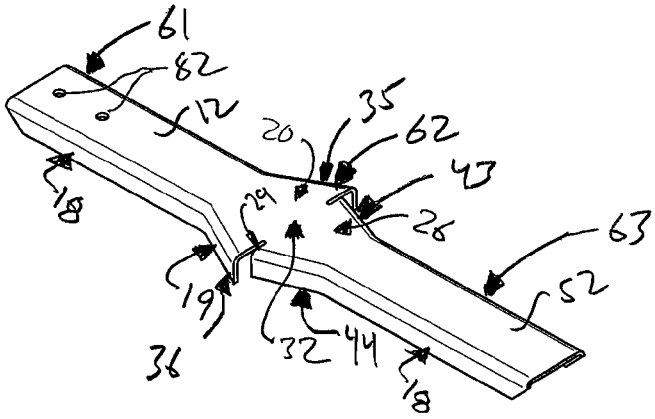
FIG. 16 is an upper rear left perspective view of the preferred form of a bridging member that has been shortened to accommodate more closely spaced studs.
Figure 17:
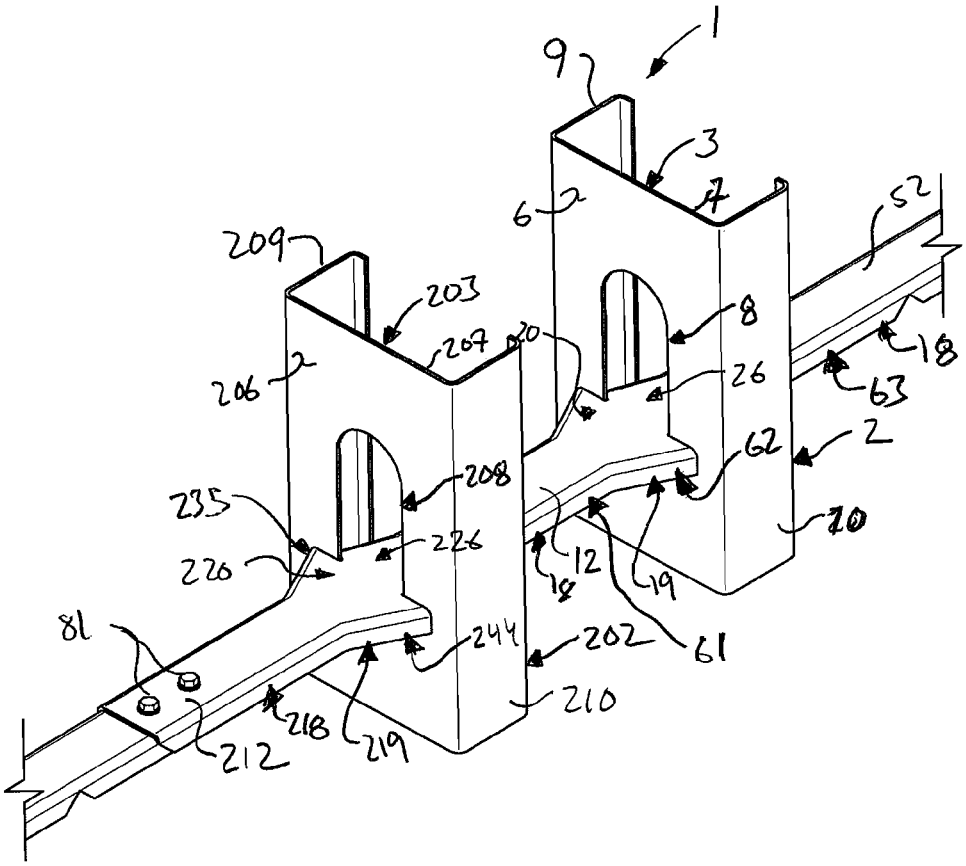
FIG. 17 is an upper front right perspective view of the present invention, showing a wall section with two typical cold-formed steel wall studs joined by the bridging members of the present invention where one of the first bridging member has been shortened.

Because the wall studs 2 and 202 and the bridging members 19 and 219 are typically made from sheet metal there are several major bends in both. Typically, the first side 4 and the second side 5 of the central web 3 of the wall stud 2 not only bound the central web 3 but also are bends as well as junctures between the central web 3 and the first and second side flanges 9 and 10 of the wall stud 2. There are bends and junctures between the first and second side flanges 9 and 10 where they meet the central web 3 of the wall stud 2, and there are also bends and junctures between the first and second side flanges 9 and 10, respectively, and the first and second stiffening flanges 57 and 58. Similarly, the first and second boundaries 13 and 14 of the first web 12 of the bridging members 19 are typically bends, as well as junctures between the first web 12 and the first and second boundary flanges 17 and 18. As shown in FIG. 11, preferably, the first and second side boundaries 33 and 34 of the first body plate 20 of the bridging members 19 are also bends, as well as junctures between the first body plate 20 and the first and second side flanges 35 and 36 of the bridging members 19. As shown in FIG. 12, preferably, the first and second side boundaries 41 and 42 of the second body plate 26 of the bridging members 19 are also bends, as well as junctures between the second body plate 26 and the first and second side flanges 43 and 44 of the first bridging member 19.

The sheet metal of the first and second body plates 20 and 26 and the first and second webs 12 and 52 of the bridging members 19 can be embossed in order to stiffen these members, while the first and second bodies 20 and 26 remain substantially planar.

Figure 4:
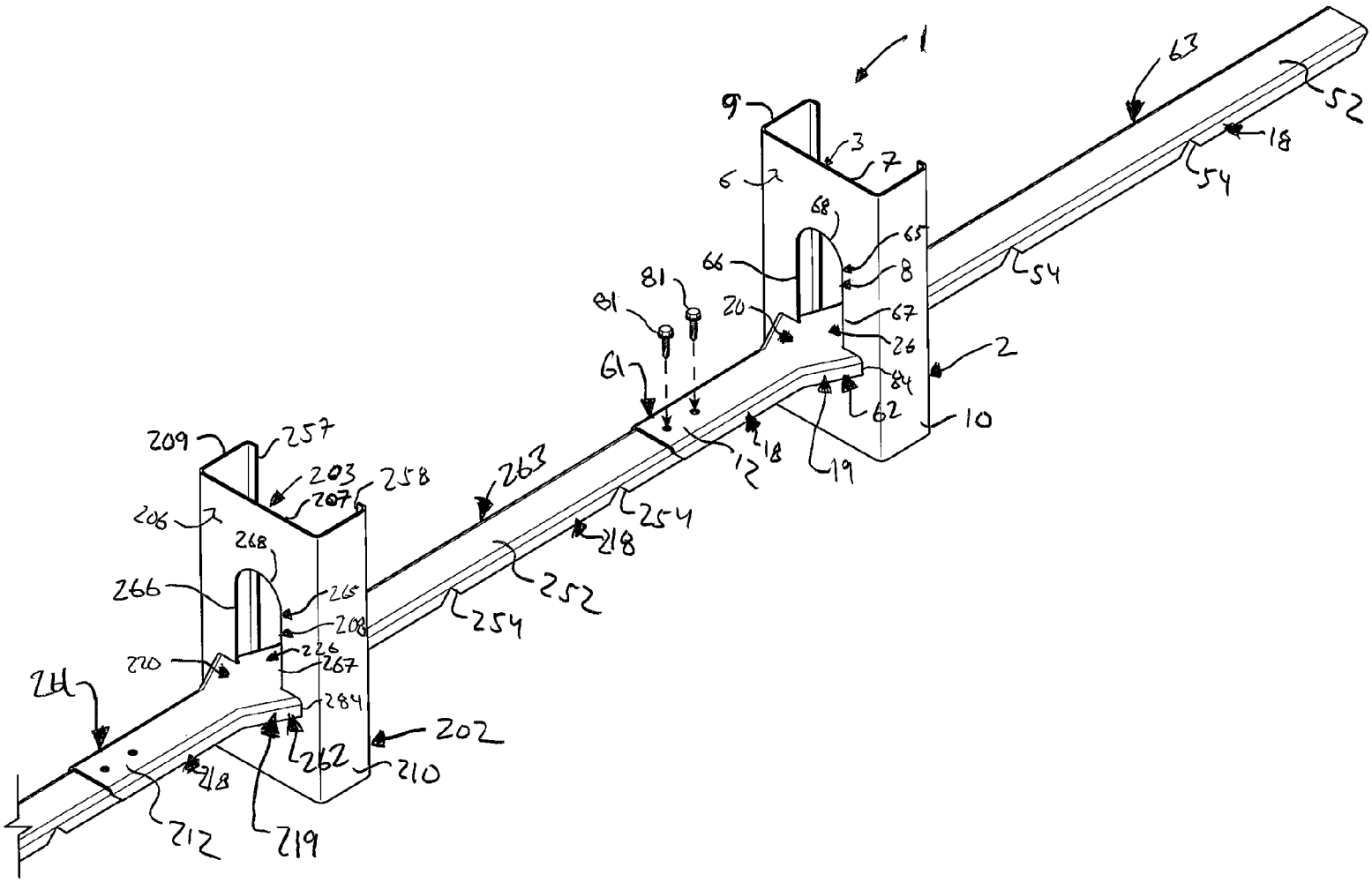
FIG. 4 is an upper front right perspective view of the present invention similar to FIG. 3, showing the second bridging member inserted through the second wall stud but and engaging the web of the second wall stud. Screws are shown as ready to connect the first bridging member to the second bridging member.

As shown in FIG. 4, typically, the elongated opening 8 in the central web 3 of the first wall stud 2 has an edge 65 with a first elongated portion 66 and a second elongated portion 67, which are mutually parallel and vertically-oriented, a first concave portion 68 that joins the first and second elongated portions 66 and 67 at the top of the elongated opening 8, and a second concave portion 69 that joins the first and second elongated portions 66 and 67 at the bottom of the elongated opening 8, opposite the first concave portion 68. This shape is variously referred to as obround, a racetrack, and super-oval when the concave portions 68 and 69 are generally semicircular.

Figure 9:
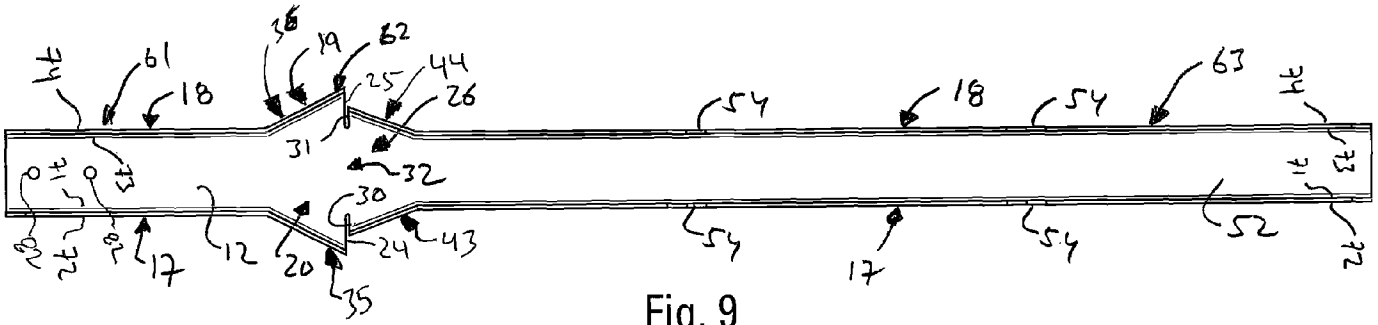
FIG. 9 is a bottom plan view of the preferred form of the bridging member of the present invention.
Figure 10:
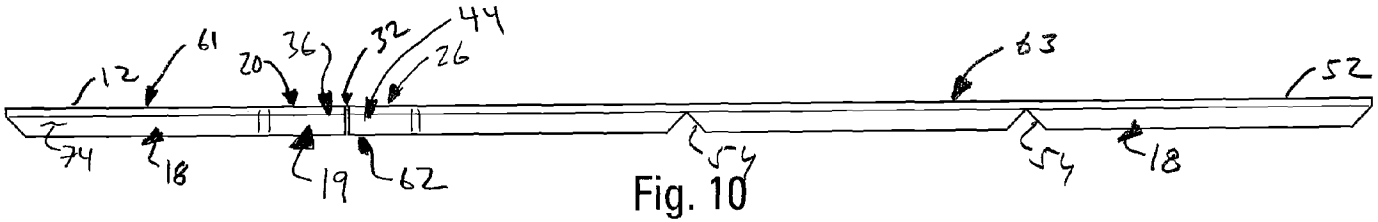
FIG. 10 is a right side elevation view of the preferred form of the bridging member of the present invention. The left side elevation view is the same.

As shown in FIG. 1, each bridging member 19 and 219 preferably is in engagement and extends through only one opening 8 and 208 in a wall stud 2 and 202, although bridging members 19 and 219 could be designed to engage with and/or extend through more than one wall stud 2 and 200. As shown in FIGS. 5 and 7, the first web 12 has a first boundary 13 and a second boundary 14, an internal surface 15 and an external surface 16. As shown in FIGS. 7, 9 and 10, the first boundary flange 17 is joined to the first boundary 13, and the first boundary flange 17 has an internal surface 71 and an external surface 72. The second boundary flange 18 is joined to the second boundary 14, and the second boundary flange 18 has an internal surface 73 and an external surface 74. The first web 12 is typically rectangular and occupies a horizontal plane. The first and a second boundary flanges 17 and 19 are typically rectangular and occupy vertical planes that are mutually parallel and are both orthogonal to the first middle web 12. The first and second webs 12 and 52 of the bridging members 19 and 219 can be any selected widths that provide a balance between strength and conservation of material and this will depend on the material used. As shown in FIG. 7, the first boundary flange 17 typically has a first outer edge 75, and the second boundary flange 18 typically has a second outer edge 76. As shown in FIGS. 5-10, these first and second outer edges 75 and 76 of the boundary flanges 17 and 18 of the bridging member 19 usually face downward; however, they can face upward. The second web 52 is formed similarly with first and second boundary flanges 17 and 18.

As shown in FIG. 7, preferably, the first body plate 20 and a second body plate 26 of the bridging members 19 are joined by a neck 32. Preferably, the first body plate 20, the second body plate 26 and the neck 32 are all generally planar.

As shown in FIGS. 5, 7 and 11, the first body 20 preferably has an interior surface 21, an exterior surface 22 opposite the interior surface 21, and a first inner edge 23 with a first web interface portion 24 and a second web interface portion 25. The first body inner edge 23 is preferably bounded by the interior surface 21 and the exterior surface 22 proximate the inner edge 23. As shown in FIGS. 5, 7 and 12, the second body 26 preferably has an interior surface 27, an exterior surface 28 opposite the interior surface 21, and a first inner edge 29 with a first web interface portion 30 and a second web interface portion 31. The first inner edge 29 is preferably bounded by the interior surface 27 and the exterior surface 28 proximate the first inner edge 29. Preferably, the first body 20 of the first mounting member 62 is connected to the first web 12 of the first connecting member 61 opposite the first inner edge 23, and the second body 26 of the mounting member 62 is connected to the second web 52 of the second connecting member 63 opposite the first inner edge 29 of the second body 26. Preferably, the first inner edge 23 of the first body 20 and the second inner edges 29 of the second body 26 are substantially opposed. The first inner edges 23 and 29 preferably lie in the same plane. Preferably, the first and second inner edges 23 and 29 occupy the same plane as the first and second bodies 20 and 26. The first and second bodies 20 and 26 preferably brace the first inner edges 23 and 29 against the central web 3 of the wall stud 2.

As shown in FIG. 5, the neck 32 preferably is disposed between the first inner edges 23 and 29, particularly between the first web interface portion 24 and the second web interface portion 25 of the first inner edge 23 and between the first web interface portion 30 and the second web interface portion 31 of the first inner edge 29.

Preferably, the interface portions 24, 25, 30 and 31 are always in contact with the central web 3 of the wall stud 2, but they may, due to differences in the thickness of the central web 3 of different wall studs, and otherwise imperfect tolerances, be adjacent to the central web 3 of the wall stud 2 without always being in contact. This is true generally of such a connection 1, in which elements are often imperfect.

Preferably, the neck 32 passes through the elongated opening 8 in the central web 3 of the wall stud 2. The first web interface portion 24 and the second web interface portion 25 of the first inner edge 23 preferably interface with either the inner surface 6 or the outer surface 7 of the central web 3 of the wall stud 2. The first web interface portion 30 and the second web interface portion 31 of the second inner edge 29 preferably interface with the other of the inner surface 6 and the outer surface 7 of the central web 3 of the wall stud 2. The neck 32 preferably is almost as wide as the typical elongate opening 8. Preferably, the first inner edge 23 of the most preferred embodiment is substantially wider than the opening 8 in central web 3 of the wall stud 2.

Preferably, the first body plate 20 has a first side boundary 33 and a second side boundary 34. A first side flange 35 is preferably attached to the first side boundary 33 and a second side flange 36 is attached to the second side boundary 34. The bridging member 19 is preferably made from sheet metal, preferably galvanized steel and the first and second side boundaries 33 and 34 are preferably bends in the material of the bridging connectors 19. As shown in FIG. 11, preferably, the first side flange 35 has an inner surface 37 and an outer surface 38 opposite the inner surface 37. Preferably, the second side flange 36 has an inner surface 39 and an outer surface 40 opposite the inner surface 39. The first side flange 35 of first body of the mounting section 62 preferably connects with the first boundary flange 17 of the first connecting section 61. The second side flange 36 of the first body 20 of the mounting section 62 preferably connects with the second boundary flange 18 of the first web 12. Preferably, the first side flange 35 and the first boundary flange 17 are at least partially nonparallel. Preferably, the second side flange 36 and the second boundary flange 18 are at least partially nonparallel.

Figure 6:
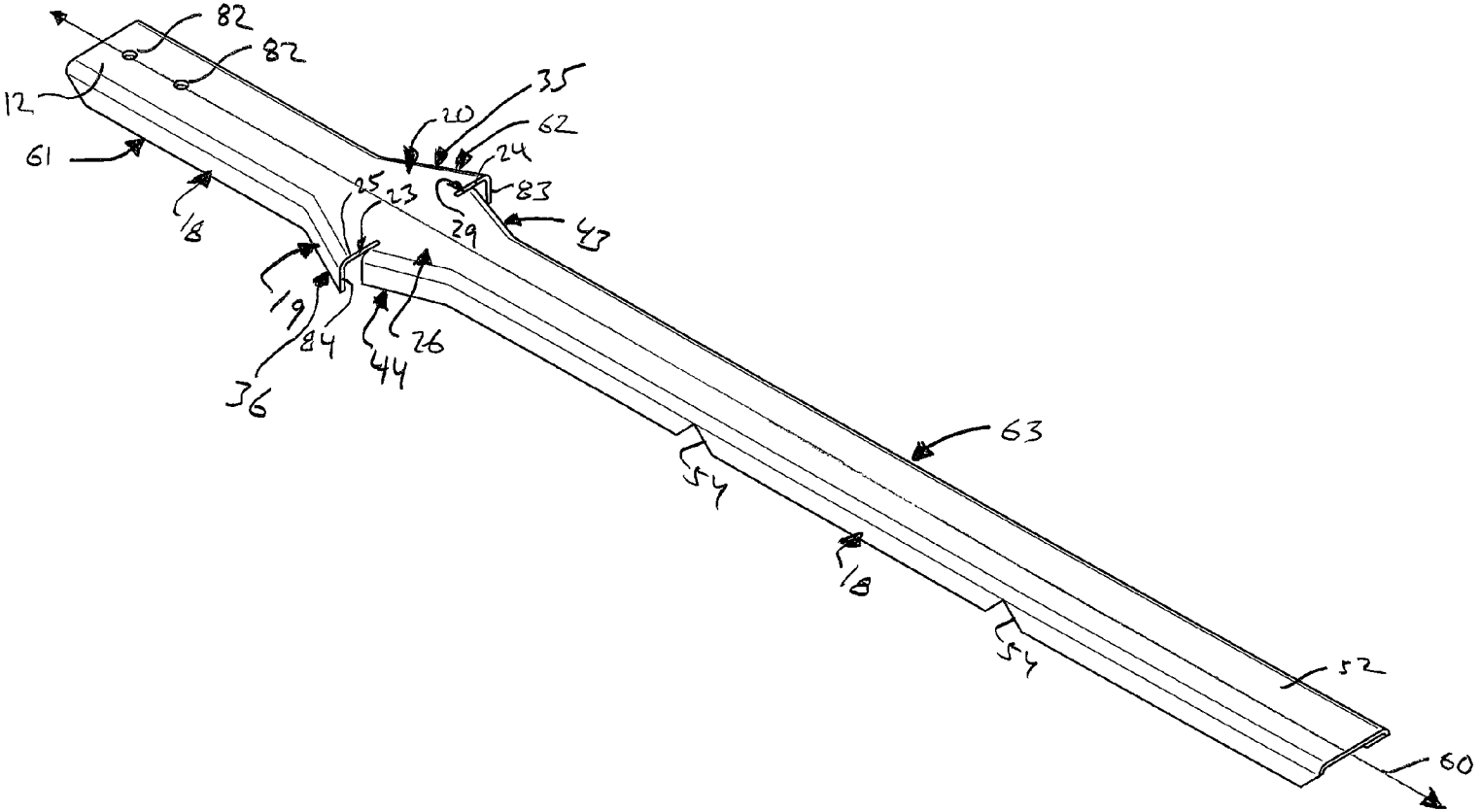
FIG. 6 is an upper rear left perspective view of the preferred form of the bridging member of the present invention.
Figure 7:
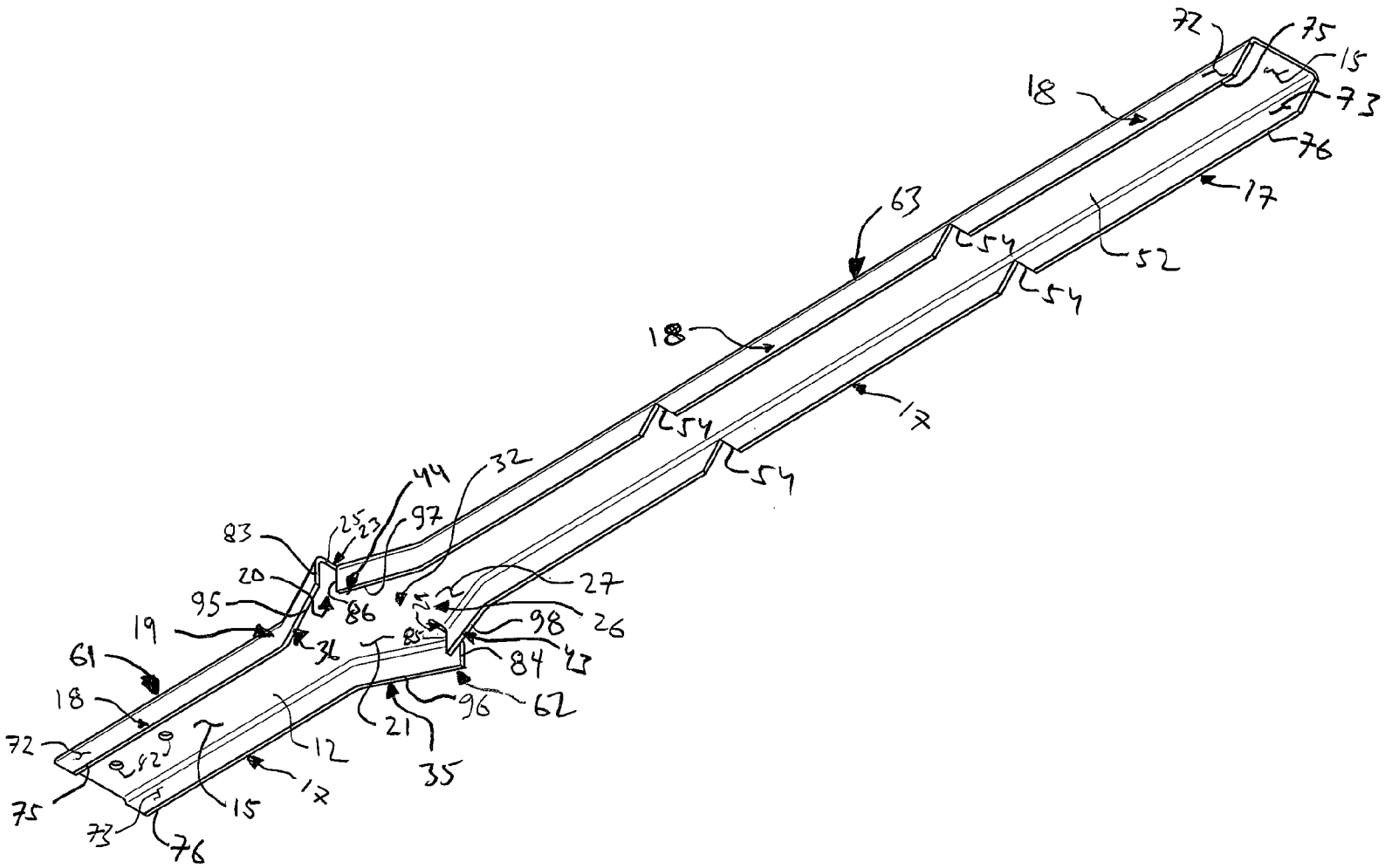
FIG. 7 is a lower rear left perspective view of the preferred form of the bridging member of the present invention.

Most preferably, as shown in FIGS. 6 and 7, the interface between the first side flange 35 with the first boundary flange 17 of the bridging member 19 occurs at a simple bend. Similarly, the interface between the second side flange 36 and the second boundary flange 18 is a simple bend.

The first and second side flanges 35 and 36 of the mounting section 62 of the present invention angle away from the first and second boundary flanges 17 and 18 of the first connecting section 61, so that the first and second side flanges 35 and 36 buttress the central web 3 where they interface with the central web, creating much greater resistance to lateral movement of the bridging member 19 than if the first and second side flanges 35 and 36 were parallel to the first and second boundary flanges 17 and 18 of the bridging member 19.

The first and second side flanges 35 and 36 are preferably straight and meet the first and second boundary flanges 17 and 18 at acute angles. This braces the interface between the first side flange 35 and the first boundary flange 17, and the interface between the first side flange 36 and the second boundary flange 18. The first and second side flanges 35 and 36 can also be curved.

As shown in FIGS. 5-10, preferably, the second body plate 26 has a first side boundary 41 and a second side boundary 42. A first side flange 43 is preferably attached to the first side boundary 41 and a second side flange 44 is preferably attached to the second side boundary 42. As shown in FIG. 12, preferably, the first side flange 43 has an inner surface 45 and an outer surface 46 opposite the inner surface 45. Preferably, the second side flange 42 has an inner surface 47 and an outer surface 48 opposite the inner surface 47. The first side flange 43 preferably interfaces with the first boundary flange 17 of the second web 52. The second side flange 44 preferably interfaces with the second boundary flange 18 of the second web 52. Preferably, the first side flange 43 and the first boundary flange 17 are at least partially nonparallel. Preferably, the second side flange 44 and the second boundary flange 18 of the second web 52 are at least partially nonparallel.

As shown in FIG. 7, typically, the first side flange 35 of the first body 20 has a lower edge 95, the second side flange 36 of the first body 20 has a lower edge 96, the first side flange 43 of the second body 26 has a lower edge 97, and the second side flange 44 of the second body 26 has a lower edge 98. The first, second, third and fourth lower edges 95, 96, 97 and 98 can have different contours, dictated in part by material conservation and, balancing that, strength.

Preferably, the first side flange 43 of the second body 26 of the mounting member 62 interfaces with the first boundary flange 17 of the second connecting section 63, and the second side flange 44 of the second body 26 of the mounting section 62 interfaces with the second boundary flange 18 of the second connecting section 63.

The first and second side flanges 43 and 44 of the second body 26 of the mounting section 62 of the present invention angle away from the first and second boundary flanges 17 and 18 of the second connecting section 63, so that the first and second side flanges 43 and 44 buttress the central web 3 at their interfaces, creating much greater resistance to lateral movement of the bridging member 19 than if the first and second side flanges 43 and 44 were parallel to the first and second boundary flanges 17 and 18 of the second connecting section 63.

The third and fourth side flanges 43 and 44 are straight and meet the first and second boundary flanges 17 and 18 of the second web 52 at acute angles. This braces the interfaces between the third and fourth side flanges 43 and 44 and the first and second boundary flanges 17 and 18 from one direction.

As shown in FIGS. 7, 11 and 12, the first side flange 35 of the first body 20 preferably has an inner end edge 83. The second side flange 36 of the first body 20 preferably has an inner end edge 84. The first side flange 43 of the second body 26 preferably has an inner end edge 85. The second side flange 44 of the second body 26 preferably has an inner end edge 86. The inner edge edges 83, 84, 85 and 86 are preferably braced against the central web 3 of the wall stud 2, thereby tying the first and second boundary flanges 17 and 18 at both ends of the bridging member 19 to the central web 3 of the wall stud 2, mutually supporting each other though one or more of the side flanges 35, 36, 43 and 44 of the mounting section 62.

Preferably, the connection 1 of the present invention is formed according to the following steps. First, a first bridging member 19 is preferably inserted through the elongated opening 8 in the central web 3 of the vertical wall stud 2. Preferably, while it is being inserted, the bridging connector 19 is positioned so that the neck 32 of the bridging connector 19 is not orthogonal to the first and second elongated portions 66 and 67 of the elongated opening 8. The second body 26 and the second web 52 of the bridging member 19 are inserted through the elongated opening 8. Preferably, the bridging member 19 is rotated so that the neck 32 is orthogonal to the first and second elongated portions 66 and 67 of the elongated opening 8, the first web interface portion 24 and the second web interface portion 25 of the first inner edge 23 interface with the central web 3 of the wall stud 2, and the first web interface portion 30 and the second web interface portion 31 of the first inner edge 29 interface with the central web 3 of the wall stud 2. The first connecting section 61 of the first bridging member 19 is then connected to the second connecting section 263 of the second bridging member 219 which is received with its mounting section 262 engaging the second stud 202.

According to the present invention, the first and second connecting sections 61 and 63 of the first and second bridging members 19 and 219 are channel shaped, and the first connecting section 61 and 261 of each of the first and second bridging members 19 and 219 has a first width, and the second connecting section 63 and 263 of each of the first and second bridging members 12 and 219 has a different second width, and the first width of the first connecting section 61 and 261 is slightly larger than the second width of the second connecting section 63 and 263 such that the second connecting section 63 of one of the first and second bridging members can nestingly engage with the first connecting section 61 of the other of the first and second bridging members.

Figure 8:
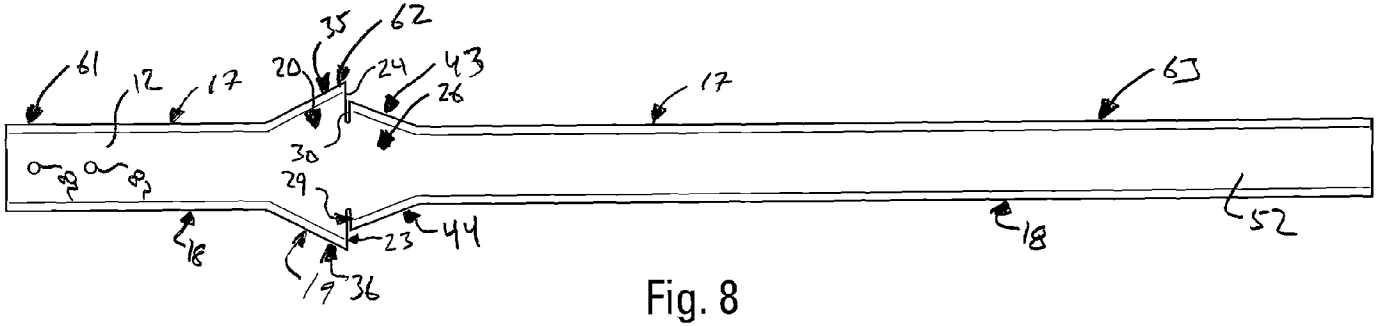
FIG. 8 is a top plan view of the preferred form of the bridging member of the present invention.

As shown in FIGS. 4 and 8, the preferred fasteners 81 for joining the bridging members 19 and 219 are metal screws 81, as shown in FIG. 1. However, any sufficiently strong fastener 81 can be used, including welds. When screws 81 are used, the first connecting section 61 of the bridging connector 19 is preferably formed with one or more fastener openings 82 sized to closely accommodate the selected screws 81. All forms of the bridging connector 19 of the present invention are shown with fastener openings 82 in the first web 12.

It is possible to use additional fasteners 81 and have additional fastener openings 82 elsewhere on the bridging member 19, such as the first web 52.

As shown, the first body plate 20 is preferably installed against the front surface 6 of the central web 3 of the wall stud 2 where it is not bounded by the first and second side flanges 9 and 10 of the wall stud 2.

It is also possible, where the width of the wall stud 2 is sufficient, to install the bridging connector 19 with the first body plate 20 against the opposite surface 7 of the central web 3 of the wall stud 2, with the second body plate 26 against the front surface 6.

Other attachments, with or without separate fasteners 81, welds, or the like are possible between the bridging members 19, but it is desirable to use the minimum number of fasteners 81 because this saves time and material and related costs.

In the preferred embodiment, the bracing members 19 and 219 are designed to attach to only one stud 2 or 202 at the mounting section 62 and to interconnect the studs 2 and 202 by connecting to other bridging members 19 and 219, thus in the preferred embodiment the first bridging member 19 does not reach the opposite face 7 of the second stud 202, and does not make any contact with the second stud 202. Similarly, the mounting section 62 of the second bridging member 219 is attached to the second stud 202, and second bridging member 219 does not reach the front side 6 of the first stud 2, such that the second bridging member 219 does not make any contact with the second stud 2.

In the preferred embodiment, at least one of the first inner edge 23 of the first body part 20 and the first inner end edge 83 of the first side flange 35 braces the first bridging member 19 against the first wall stud 2.

The preferred method of making the connection between a plurality of studs 2 and 202 with one or more of the bridging members 19 and 219 of the present invention involves placing the first body parts 20 and 220 of one or more bridging members 19 and 219 adjacent the central web 3 and 203 of a plurality of wall studs 2 and 202 so that the first inner edges 83 and 283 of the first side flanges 35 and 235 of the first bodies 20 and 220 are adjacent the central web 3 and 203 of the studs 2 and 202 and fastening the second connecting sections 63 and 263 of the bridging members 19 and 219 to the first connecting sections 61 and 261 of the bridging members 19 and 219.

The first and second connecting sections 61 and 261, 63 and 263 of the bridging members 19 and 219 can be a variety of lengths and notches 54 and 254 can be provided in the elongated flanges 17 and 18, 217 and 218 of the connecting sections 61 and 261, 63 and 263 to allow for the trimming of the connecting sections 61 and 261, 63 and 263. As shown in the drawings, only the second connecting sections 63 and 263 are notched, but either or both could be notched. Preferably, the connecting sections 61 and 261, 63 and 263 are notched at selected locations that correspond to using a plurality of the bridging members 19 and 219 together to span standard spacings between adjacent studs 2 and 202.

We claim:

1. A connection between a first stud, a second stud, a first bridging member and a second bridging member, the connection comprising:

a. said first stud having a front face and an opposite face disposed laterally therefrom on the opposed face of the first stud, the first stud having an opening there through that communicates between the front face and the opposite face of the first stud;

b. said second stud having a front face and an opposite face disposed laterally therefrom on the opposed face of the second stud, said second stud being disposed substantially parallel to and spaced a selected distance away from said first stud, said opposite face of said second stud facing and being disposed parallel to said front face of said first stud, the second stud having an opening there through that communicates between the front face and the opposite face of the second stud;

c. said first bridging member engaging the first stud and received in the opening of the first stud, the first bridging member having a longitudinal, central axis with a mounting section and opposed first and second connecting sections on either side of the mounting section along the longitudinal, central axis, said mounting section of said first bridging member being received in the opening of the first stud, said second connecting section projecting substantially away from said opposite face of said first stud and also from said opposite face of said second stud, and said first connecting section of said first bridging member projects away from said front face of said first stud and extends towards said opposite face of said second stud;

d. said second bridging member engaging the second stud and received in the opening of the second stud, the second bridging member having a longitudinal, central axis with a mounting section and opposed first and second connecting sections on either side of the mounting section along the longitudinal axis of said second bridging member, said mounting section of said second bridging member engaging said second stud and being received in said opening of said second stud, said second connecting section projecting substantially away from said opposite face of said second stud and extending toward said front face of said first stud, said second connecting section of said second bridging member engaging said first connecting section of said first bridging member such that the second stud is braced by the first stud, said first connecting section of said second bridging member projecting away from said front face of said second stud and projecting away from said front face of said first stud;

e. said mounting section of said first bridging member having a first body part, said first body part having a first side flange attached to the first body part at an angle thereto, the first body part of the mounting section also having a first inner edge with a first web interface portion and a second web interface portion, the first inner edge contacting or being closely adjacent to the front face of said first stud, f. said mounting section of said first bridging member having a second body part joined to the first body part by a neck that passes through the opening in the first stud, said second body part having a first side flange attached to the second body part at an angle thereto, the second body part of the mounting section having a first inner edge facing the opposite face of the first stud, the first inner edge having a third web interface portion and a fourth web interface portion, the first inner edge contacting or being closely adjacent to the opposite face of said first stud; wherein the first side flange of the first body part is set at an acute angle with respect to the longitudinal axis of the first bridging member such that the first side flange flares outwardly from the longitudinal, central axis as it approaches the central web of the first stud.

2. The connection of claim 1, wherein:

the first side flange of the first body part has an inner edge that contacts or lies closely adjacent to the central web of the first wall stud.

3. The connection of claim 1, wherein:

the first side flange of the second body part has an inner edge that contacts or lies closely adjacent to the central web of the first wall stud.

4. The connection of claim 3, wherein:

the first side flange of the second body part is set at an acute angle with respect to the longitudinal axis of the first bridging member such that the first side flange flares outwardly from the longitudinal, central axis as it approaches the central web of the first stud.

5. The connection of claim 1, wherein:

a second side flange is attached to the first body part at an angle thereto.

6. The connection of claim 5, wherein:

the second side flange of the first body part has an inner edge that contacts or lies closely adjacent to the central web of the first wall stud.

7. The connection of claim 6, wherein:

the second side flange of the first body part is set at an acute angle with respect to the longitudinal axis of the first bridging member such that the second side flange flares outwardly from the longitudinal, central axis as it approaches the central web of the first stud.

8. The connection of claim 1, wherein:

a second side flange is attached to the second body part at an angle thereto.

9. The connection of claim 8, wherein:

the second side flange of the second body part has an inner edge that contacts or lies closely adjacent to the central web of the first wall stud.

10. The connection of claim 9, wherein:

the second side flange of the second body part is set at an acute angle with respect to the longitudinal axis of the first bridging member such that the second side flange flares outwardly from the longitudinal, central axis as it approaches the central web of the first stud.

11. The connection of claim 1, wherein:
the first body part is substantially planar.

12. The connection of claim 1, wherein:
the second body part is substantially planar and lies in substantially the same plane as the first body part.

13. The connection of claim 1, wherein:
the first and second connecting sections of the first and second bridging members are channel shaped.

14. The connection of claim 13, wherein:
the first connecting section of each of the first and second bridging members has a first width, and the second connecting section of each of the first and second bridging members has a different second width, and one of the first width and the second width is slightly larger than the other of the first and second widths, such that the second connecting section of one of the first and second bridging members can nestingly engage with the first connection section of the other of the first and second bridging members.

15. The connection of claim 1, wherein:
a. said mounting section of said second bridging member has a first body part, said first body part has a first side flange attached to the first body part at an angle thereto, the first body part of the mounting section also has a first inner edge with a first web interface portion and a second web interface portion, the first inner edge contacting or being closely adjacent to the front face of said second stud,
b. said mounting section of said second bridging member having a second body part joined to the first body part by a neck that passes through the opening in the second stud, said second body part having a first side flange attached to the second body part at an angle thereto, the second body part of the mounting section having a first inner edge facing the opposite face of the second stud, the first inner edge having a third web interface portion and a fourth web interface portion, the first inner edge contacting or being closely adjacent to the opposite face of said second stud.

16. The connection of claim 15, wherein:
the first side flange of the first body part has an inner edge that contacts or lies closely adjacent to the central web of the first wall stud.

17. The connection of claim 16, wherein:
the first side flange of the first body part is set at an acute angle with respect to the longitudinal axis of the first bridging member such that the first side flange flares outwardly from the longitudinal, central axis as it approaches the central web of the first stud.

18. The connection of claim 15, wherein:
the first side flange of the second body part has an inner edge that contacts or lies closely adjacent to the central web of the first wall stud.

19. The connection of claim 18, wherein:
the first side flange of the second body part is set at an acute angle with respect to the longitudinal axis of the first bridging member such that the first side flange flares outwardly from the longitudinal, central axis as it approaches the central web of the first stud.

20. A connection between a first stud, a second stud, a first bridging member and a second bridging member, the connection comprising:
a. said first stud having a front face and an opposite face disposed laterally therefrom on the opposed face of the first stud, the first stud having an opening there through that communicates between the front face and the opposite face of the first stud;
b. said second stud having a front face and an opposite face disposed laterally therefrom on the opposed face of the second stud, said second stud being disposed substantially parallel to and spaced a selected distance away from said first stud, said opposite face of said second stud facing and being disposed parallel to said front face of said first stud, the second stud having an opening there through that communicates between the front face and the opposite face of the second stud;
c. said first bridging member engaging the first stud and received in the opening of the first stud, the first bridging member having a longitudinal, central axis with a mounting section and opposed first and second connecting sections on either side of the mounting section along the longitudinal, central axis, said mounting section of said first bridging member being received in the opening of the first stud, said second connecting section projecting substantially away from said opposite face of said first stud and also from said opposite face of said second stud, and said first connecting section of said first bridging member projects away from said front face of said first stud and extends towards said opposite face of said second stud;
d. said second bridging member engaging the second stud and received in the opening of the second stud, the second bridging member having a longitudinal, central axis with a mounting section and opposed first and second connecting sections on either side of the mounting section along the longitudinal axis of said second bridging member, said mounting section of said second bridging member engaging said second stud and being received in said opening of said second stud, said second connecting section projecting substantially away from said opposite face of said second stud and extending toward said front face of said first stud, said second connecting section of said second bridging member engaging said first connecting section of said first bridging member such that the second stud is braced by the first stud, said first connecting section of said second bridging member projecting away from said front face of said second stud and projecting away from said front face of said first stud;
e. said mounting section of said first bridging member having a first body part, said first body part having a first side flange attached to the first body part at an angle thereto, the first side flange has an inner edge that contacts or lies closely adjacent to the central web of the first wall stud, the first side flange of the first body part is set at an acute angle with respect to the longitudinal axis of the first bridging member such that the first side flange flares outwardly from the longitudinal, central axis as it approaches the central web of the first stud,
f. said mounting section of said first bridging member having a second body part joined to the first body part by a neck that passes through the opening in the first stud, said second body part having a first side flange attached to the second body part at an angle thereto, the first side flange of the second body part has an inner edge that contacts or lies closely adjacent to the central web of the first wall stud, the first side flange of the second body part is set at an acute angle with respect to the longitudinal axis of the first bridging member such that the first side flange flares outwardly from the longitudinal, central axis as it approaches the central web of the first stud.

21. The connection of claim 20, wherein:
a second side flange is attached to the first body part at an angle thereto.

22. The connection of claim 21, wherein:

the second side flange of the first body part has an inner edge that contacts or lies closely adjacent to the central web of the first wall stud.

23. The connection of claim 22, wherein:

the second side flange of the first body part is set at an acute angle with respect to the longitudinal axis of the first bridging member such that the second side flange flares outwardly from the longitudinal, central axis as it approaches the central web of the first stud.

24. The connection of claim 20, wherein:

a second side flange is attached to the second body part at an angle thereto.

25. The connection of claim 24, wherein:

the second side flange of the second body part has an inner edge that contacts or lies closely adjacent to the central web of the first wall stud.

26. The connection of claim 25, wherein:

the second side flange of the second body part is set at an acute angle with respect to the longitudinal axis of the first bridging member such that the second side flange flares outwardly from the longitudinal, central axis as it approaches the central web of the first stud.

27. The connection of claim 20, wherein:

the first body part is substantially planar.

28. The connection of claim 20, wherein:

the second body part is substantially planar and lies in substantially the same plane as the first body part.

29. The connection of claim 20, wherein:

the first and second connecting sections of the first and second bridging members are channel shaped.

30. The connection of claim 29, wherein:

the first connecting section of each of the first and second bridging members has a first width, and the second connecting section of each of the first and second bridging members has a different second width, and one of the first width and the second width is slightly larger than the other of the first and second widths, such that the second connecting section of one of the first and second bridging members can nestingly engage with the first connection section of the other of the first and second bridging members.

31. The building connection of claim 20 wherein:

a. said mounting section of said second bridging member has a first body part, said first body part has a first side flange attached to the first body part at an angle thereto, the first side flange has an inner edge that contacts or lies closely adjacent to the central web of the second wall stud, the first side flange of the first body part is set at an acute angle with respect to the longitudinal axis of the second bridging member such that the first side flange flares outwardly from the longitudinal, central axis as it approaches the central web of the second stud, b. said mounting section of said second bridging member has a second body part joined to the first body part by a neck that passes through the opening in the second stud, said second body part having a first side flange attached to the second body part at an angle thereto, the first side flange of the second body part has an inner edge that contacts or lies closely adjacent to the central web of the second wall stud, the first side flange of the second body part is set at an acute angle with respect to the longitudinal, central axis of the second bridging member such that the first side flange flares outwardly from the longitudinal, central axis as it approaches the central web of the second stud.

32. A method of making the connection of claim 1 comprising the steps of:

a. placing the first body part of the first bridging member adjacent the central web of the first wall stud so that the first inner edge of the first side flange of the first body part is adjacent the central web of the first stud; and b. placing the first body part of the second bridging member adjacent the central web of the second wall stud so that the first inner edge of the first side flange of the first body part is adjacent the central web of the second stud;

c. fastening the second connecting section of the second bridging member to the first connecting section of the first bridging member.

* * * * *